US010308384B2

(12) United States Patent
Ikawa

(10) Patent No.: US 10,308,384 B2
(45) Date of Patent: Jun. 4, 2019

(54) METHOD FOR PACKING STACKED BUNDLES MADE OF PAPER

(71) Applicant: Clinpet Japan Co., Ltd., Saijo, Ehime (JP)

(72) Inventor: Shinichi Ikawa, Saijo (JP)

(73) Assignee: CLINPET JAPAN CO., LTD., Saijo (JP)

( * ) Notice: Subject to any disclaimer, the term of this patent is extended or adjusted under 35 U.S.C. 154(b) by 361 days.

(21) Appl. No.: 14/892,416

(22) PCT Filed: Mar. 17, 2015

(86) PCT No.: PCT/JP2015/057883

§ 371 (c)(1),
(2) Date: Nov. 19, 2015

(87) PCT Pub. No.: WO2015/141671

PCT Pub. Date: Sep. 24, 2015

(65) Prior Publication Data

US 2016/0368631 A1 Dec. 22, 2016

(30) Foreign Application Priority Data

Mar. 17, 2014 (JP) ..... 2014-054098

(51) Int. Cl.
*B65B 5/06* (2006.01)
*B65B 25/14* (2006.01)
(Continued)

(52) U.S. Cl.
CPC ..... *B65B 25/145* (2013.01); *B65B 5/067* (2013.01); *B65B 31/024* (2013.01);
(Continued)

(58) Field of Classification Search
CPC ..... B65B 5/061; B65B 5/067; B65B 11/58; B65B 25/145; B65B 27/08; B65B 27/125;
(Continued)

(56) References Cited

U.S. PATENT DOCUMENTS 2,374,147 A * 4/1945 Weeks ..... B65B 7/04 53/372.6
2,613,862 A 10/1952 Vaughn
(Continued)

FOREIGN PATENT DOCUMENTS

CN 2522344 11/2002
CN 1646391 7/2005
(Continued)

OTHER PUBLICATIONS

European Search Report, dated Oct. 10, 2017, European Patent Office, 14 pages.
(Continued)

*Primary Examiner* — Stephen F. Gerrity
(74) *Attorney, Agent, or Firm* — STIP Law Group, LLC

(57) ABSTRACT

A method for packing stacked bundles made of papers. An operator firstly arranges three bundles of paper towels laterally and put the three bundles in a packaging member. As the packaging member, a commercially available bag made of polyethylene is used. Next, by using a vacuum apparatus, in order to produce a vacuum packaged body, air in the packaging member is sucked until the thickness of the bundles is reduced to a half or so. Next, a plurality of the vacuum packaged bodies is packed in a corrugated cardboard box. The vacuum packaged body can be gradually swelling when several hours pass since vacuum-packaging. Finally, the operator seals the corrugated cardboard box.

3 Claims, 9 Drawing Sheets

(51) Int. Cl.

| | |
|---|---|
| ***B65B 31/02*** | (2006.01) |
| ***B65B 63/02*** | (2006.01) |
| ***B65D 77/02*** | (2006.01) |
| ***B65D 81/20*** | (2006.01) |
| ***B65D 85/07*** | (2017.01) |
| ***B65D 85/62*** | (2006.01) |

(52) U.S. Cl.
CPC ..... *B65B 63/028* (2013.01); *B65D 77/02* (2013.01); *B65D 81/2023* (2013.01); *B65D 85/07* (2018.01); *B65D 85/62* (2013.01)

(58) Field of Classification Search
CPC ..... B65B 31/024; B65B 35/50; B65B 61/00; B65B 63/028; B65B 2220/16; B65B 2220/18; B65D 77/02; B65D 81/2023; B65D 85/07; B65D 85/62
USPC ..... 53/429, 433, 434, 436, 443, 447, 449, 53/511, 512, 116, 117, 526, 527, 540, 53/171, 173
See application file for complete search history.

(56) References Cited

U.S. PATENT DOCUMENTS

| | | | | | |
|---|---|---|---|---|---|
| 3,330,089 | A * | 7/1967 | Uematsu | B65D 75/04 | 206/526 |
| 3,382,643 | A * | 5/1968 | Hullhorst et al. | B65B 63/028 | 100/90 |
| 3,641,726 | A * | 2/1972 | Cassina | B65B 63/028 | 297/356 |
| 3,877,562 | A * | 4/1975 | Shaw | B65B 25/146 | 198/429 |
| 4,418,514 | A * | 12/1983 | Spann | B65B 31/00 | 206/524.8 |
| 5,177,934 | A * | 1/1993 | Yamamoto | B65D 81/2023 | 53/429 |
| 5,447,012 | A * | 9/1995 | Kovacs et al. | B65B 25/146 | 53/370.6 |
| 5,540,354 | A * | 7/1996 | Annand | A47K 10/423 | 206/449 |
| 5,666,786 | A * | 9/1997 | Focke et al. | B65B 63/02 | 53/247 |
| 6,026,957 | A * | 2/2000 | Bauer et al. | B65D 71/0085 | 206/494 |
| 6,658,819 | B2 * | 12/2003 | Gamberini | B65B 25/14 | 53/436 |
| 2010/0078444 | A1 * | 4/2010 | Shannon et al. | B65D 83/0805 | 221/63 |
| 2010/0089007 | A1 * | 4/2010 | Milican et al. | B65D 77/04 | 53/449 |
| 2010/0243504 | A1 * | 9/2010 | Long et al. | B65D 77/04 | 206/494 |
| 2011/0036055 | A1 * | 2/2011 | Shibagaki | B65B 5/067 | 53/266.1 |
| 2012/0234712 | A1 * | 9/2012 | Moore et al. | B65B 27/125 | 206/391 |

FOREIGN PATENT DOCUMENTS

| | | | | |
|---|---|---|---|---|
| JP | 01182218 | A | * | 7/1989 |
| JP | 03200515 | A | * | 9/1991 |
| JP | 4-279419 | A | | 10/1992 |
| JP | 7-52978 | A | | 2/1995 |
| JP | 7-285584 | | | 10/1995 |
| JP | 7-285584 | A | | 10/1995 |
| JP | 9-86525 | A | | 3/1997 |
| JP | 9-142550 | | | 6/1997 |
| JP | 9-142550 | A | | 6/1997 |
| JP | 09142550 | A | * | 6/1997 |
| JP | 2002-85287 | A | | 3/2002 |
| WO | WO03020593 | A1 | | 3/2003 |

OTHER PUBLICATIONS

International Search Report (PCT/ISA/210) issued in PCT Application No. PCT/JP2015/057883 dated Jun. 16, 2015 with English translation (five pages).
Japanese-language Written Opinion (PCT/ISA/237) issued in PCT Application No. PCT/JP2015/057883 dated Jun. 16, 2015 (five pages).
Extended European Search Report, dated Jan. 18, 2018, European Patent Office, 12 pages.
Office Action from the Chinese Patent Office, dated Sep. 5, 2016, 12 pages.
Office Action from State Intellectual Property Office of People's Republic of China, dated Aug. 3, 2018, English Translation.
Office Action from European Patent Office, dated Jul. 12, 2018.
Office Action from European Office of 15 764 697.7, dated Nov. 13, 2018.
Office action from China National Intellectual Property Administration of People's Republic of China of 201710473496.8, dated Mar. 8, 2019, English translation.

* cited by examiner

FIG. 8A
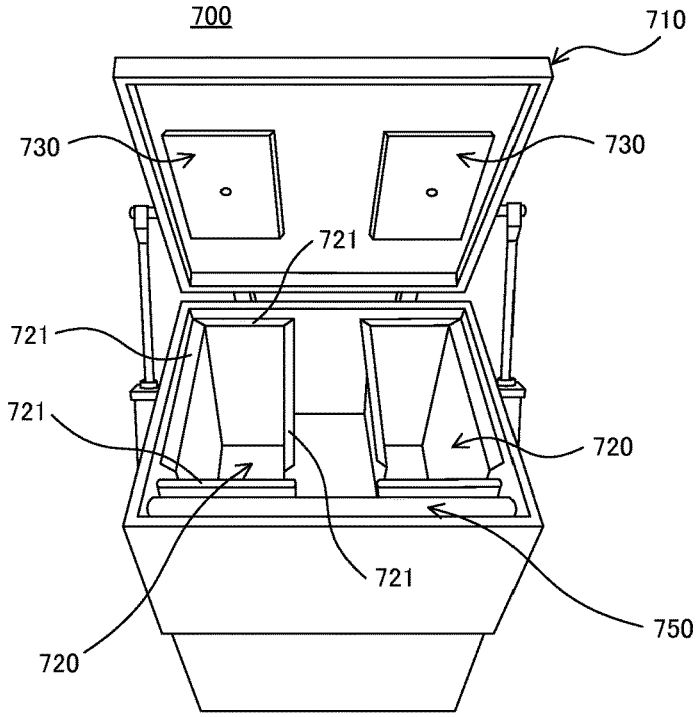
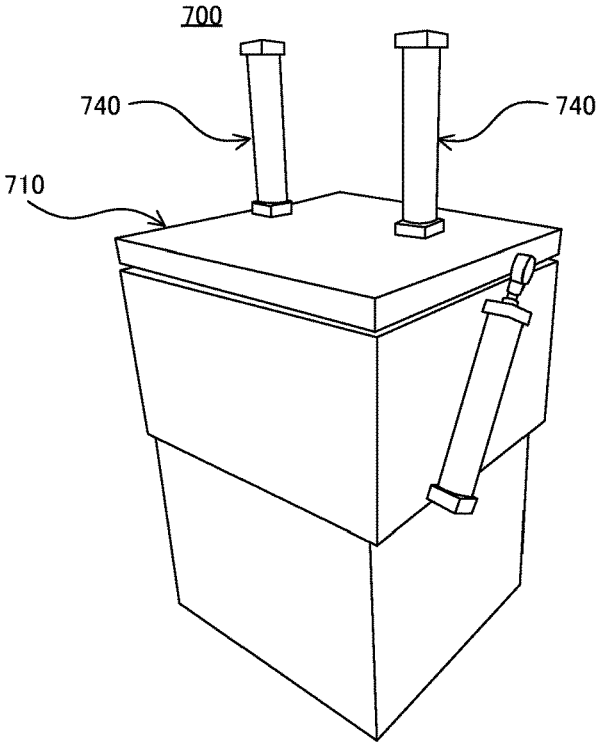
FIG. 8B

METHOD FOR PACKING STACKED BUNDLES MADE OF PAPER

TECHNICAL FIELD

The present invention relates to a method for packing stacked bundles made of paper that is used when the stacked bundles made of paper such as bundles of paper towels, tissue paper, sheet-like nonwoven fabric, etc., produced in a factory are put in a predetermined storing body and packed, and a packed body of the stacked bundles made of paper packed by the method.

BACKGROUND ART

When the stacked bundles made of paper such as bundles of paper towels, tissue paper, sheet-like nonwoven fabric, etc., produced in a factory are shipped, the stacked bundles made of paper are packed by putting the stacked bundles made of paper in a rectangular parallelepiped shape corrugated cardboard box that is matched with the sizes and the number of the stacked bundles made of paper. Here, the stacked bundle made of paper is constituted by stacking a plurality of sheet-like members made of paper, or constituted by folding one sheet-like member made of paper or a plurality of sheet-like members made of paper and stacking a plurality of the folded sheet-like members made of paper (for example, see Patent Document 1.). For example, a bundle of paper towels includes 200 sheet-like members made of paper, and 40 bundles of paper towels are put in one corrugated cardboard box.

RELATED ART DOCUMENTS

Patent Documents

Patent Document 1: Japanese Unexamined Patent Application Publication No. 2002-085287.

DISCLOSURE OF THE INVENTION

Problems to be Solved by the Invention

By the way, a size of the corrugated cardboard box in which a plurality of the stacked bundles made of paper are put is significantly large, so that there are problems that transportation cost of these many corrugated cardboard boxes increases, and a large space is required to store the corrugated cardboard boxes in a warehouse, etc., whereby inventory load is large.

The present invention has been accomplished in view of the above-described circumstances, and has an object to provide a method for packing stacked bundles made of paper that can reduce transportation cost of the stacked bundles made of paper and can reduce the storage space in a warehouse, etc., and to provide a packed body of stacked bundles made of paper packed by the method.

Means to Solve the Problems

The present invention to accomplish the above-described objects relates to a method for packing stacked bundles made of paper that are constituted by stacking a plurality of sheet-like members made of paper, the method includes a compression process in which the stacked bundles made of paper are packaged by a freely deformable packaging member, air in the packaging member is sucked to compress the stacked bundles made of paper whereby producing a vacuum packaged body in which the stacked bundles made of paper are at least temporarily vacuum packaged, and a packing process in which a plurality of the vacuum packaged bodies produced in the compression process are packed in a predetermined storing body. Here, in the compression process, for example, air in the packaging member is sucked so that a thickness of the stacked bundles made of paper put in the packaging member reduces by 30% to 70%. In addition, as the storing body, for example, a corrugated cardboard box may be used.

In the present invention, the stacked bundles made of paper are compressed to produce the vacuum packaged body, and a plurality of the vacuum packaged bodies are packed in the storing body, whereby much amount of the stacked bundles made of paper can be put in the storing body as compared with the case where the stacked bundles made of paper are not compressed. Therefore, transportation cost of the stacked bundles made of paper can be reduced, and a space necessary for storing the stacked bundles made of paper, for example, in a warehouse, etc., can be reduced.

Also, in the compression process, it is desired that a plurality of the stacked bundles made of paper are put in the packaging member in the state of being arranged in a plurality of rows in the horizontal direction and piled in a plurality of steps in the vertical direction. As a result, the operation in the compression process can be carried out efficiently.

Further, in the method for packing stacked bundles made of paper according to the present invention, it is desired that the packaging member to be used for producing the vacuum packaged body has a property of only temporarily maintaining the vacuum state of the vacuum packaged body. As a result, the packaging member of the vacuum packaged body is, for example, gradually swelling out when several hours pass since the vacuum packaging, so that even if there is a little gap in the storing body in which the vacuum packaged bodies are packed, the stacked bundles made of paper are made the state of being firmly and densely packed in the storing body. Therefore, the storing body becomes firm and strong, not easily collapsing by pressure. Accordingly, at the time of transportation or at the time of storage in a warehouse, even if the storing bodies are piled up, the storing bodies can be easily handled without being conscious of damage of the storing bodies. In this case, in particular, the storing body is desirably a bag made of kraft paper. According to this constitution, for example, as compared with the case where a corrugated cardboard box is used, remarkable cost reduction of the packing material can be done.

Moreover, in the packing process, after a plurality of the vacuum packaged bodies produced in the compression process are packed in the storing body made of kraft paper, the packaging member may be perforated to make a plurality of the vacuum packaged bodies the state of being densely packed in the storing body. According to this procedure, the packing operation can be finished within a short period of time. Also, since the storing body made of kraft paper is used, the package can be easily unpacked only by cutting the kraft paper, or by tearing the kraft paper off by hands.

Also, a packed body of stacked bundles made of paper according to the present invention to accomplish the above-described objects is packed by the above-described method for packing stacked bundles made of paper. By producing the packed body of the stacked bundles made of paper using the above-described method for packing the stacked bundles made of paper, transportation cost of the stacked bundles made of paper can be reduced and the storage space in a warehouse, etc., can be reduced.

Effects of the Invention

In the method for packing stacked bundles made of paper according to the present invention, by compressing the stacked bundles made of paper to produce the vacuum packaged body, and packing a plurality of the vacuum packaged bodies in the storing body, more stacked bundles made of paper can be put in the storing body as compared with the case where the stacked bundles made of paper are not compressed, so that transportation cost of the stacked bundles made of paper can be reduced and a space necessary for storing the stacked bundles made of paper, for example, in a warehouse, etc., can be reduced.

BRIEF DESCRIPTION OF THE DRAWINGS

FIGS. 8A and 8B are schematic perspective views of a vacuum apparatus to be used in the method for packing the stacked bundles made of paper of the second embodiment.

MODE FOR CARRYING OUT THE INVENTION

In the following, embodiments for carrying out an invention according to the present application will be described with reference to the drawings.

A method for packing stacked bundles made of paper according to the present invention is used when the stacked bundles made of paper produced in a factory are put in a predetermined storing body and packed. The stacked bundle made of paper herein mentioned is constituted by stacking a plurality of sheet-like members made of paper. Examples of the stacked bundle made of paper include a bundle of paper towels, tissue paper, sheet-like nonwoven fabric, etc. The paper towel is used for wiping wet hands after washing the hands. Therefore, suitable flexibility and wet strength are required for the paper towel. Also, the tissue paper is used for blowing one's nose or wiping one's mouth. Therefore, high strength as required for the paper towel is not required for the tissue paper, and softness is rather required than the strength. Further, the sheet-like nonwoven fabric is used, for example, as thick kitchen paper. Therefore, high strength as well as suitable water absorbency is required for the sheet-like nonwoven fabric. In the following, in this embodiment, the case where a bundle of paper towels is used as the stacked bundle made of paper is explained.

Figure 1:
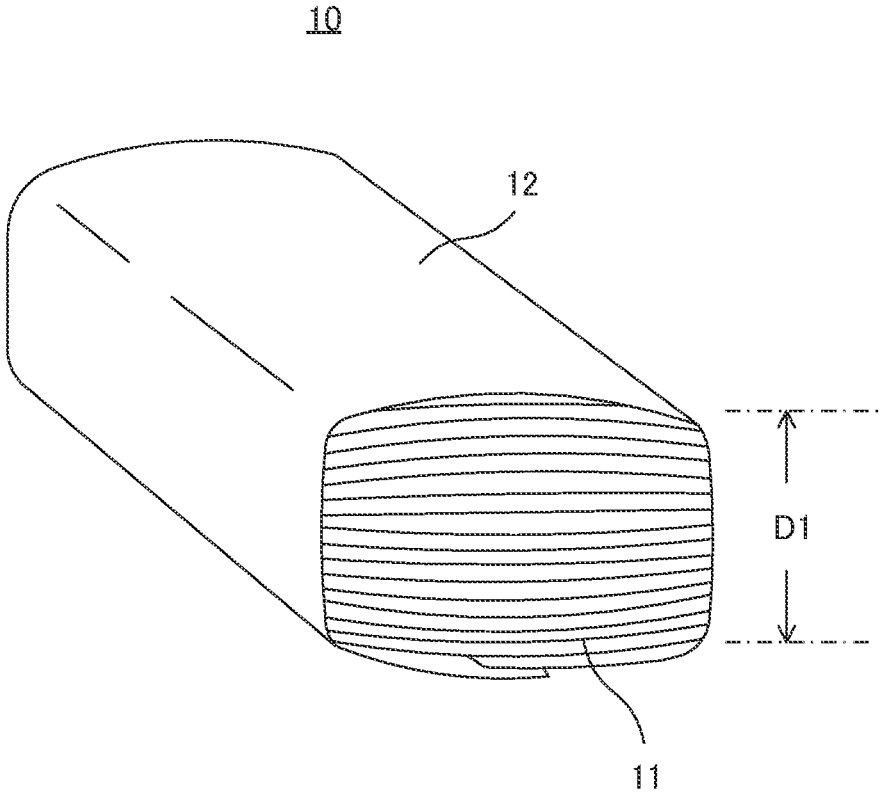
FIG. 1 is a schematic perspective view of a bundle of paper towels that is the stacked bundle made of paper.

Base paper of paper towels is produced by the same method as base paper of tissue paper or sheet-like toilet paper, etc. Different points of the production method of the base paper of paper towels from the production method of the base paper of tissue paper, etc., are that chemicals (paper strengthening agents) for strengthening wet strength are used, and the paper thickness is about 2 to 5 times as thick as that of tissue paper, etc. In general, whereas the paper thickness of tissue paper is about 11 g/m$^2$ and the paper thickness of sheet-like toilet paper is about 18 g/m$^2$, the paper thickness of paper towel is about 23 to 50 g/m$^2$. By cutting the base paper of paper towels to a predetermined size, sheet-like members made of paper can be obtained. Thereafter, a plurality of the sheet-like members made of paper are folded and stacked. Such an operation of cutting and folding can be automatically carried out by using a commercially available folding machine. Finally, by packaging the stacked plurality of the sheet-like members made of paper, a bundle of paper towels is produced. FIG. 1 is a schematic perspective view of a bundle of paper towels that is the stacked bundle made of paper. More specifically, in this FIG. 1, a bundle of paper towels 10 obtained by tying 200 sheet-like members made of paper 11 with a paper band 12 is shown. Also, with regard to this bundle of paper towels 10, a width is about 110 mm, a height is about 225 mm and a thickness D1 is about 60 mm.

First Embodiment

Figure 2:
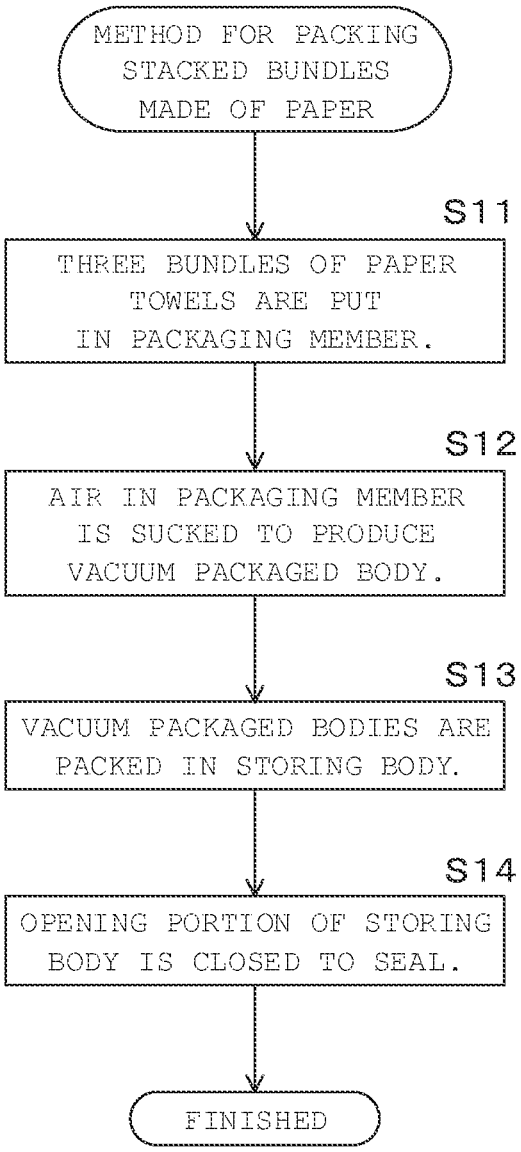
FIG. 2 is a flowchart for explaining an operation procedure according to a method for packing the stacked bundles made of paper of the first embodiment of the present invention.
Figure 3A:
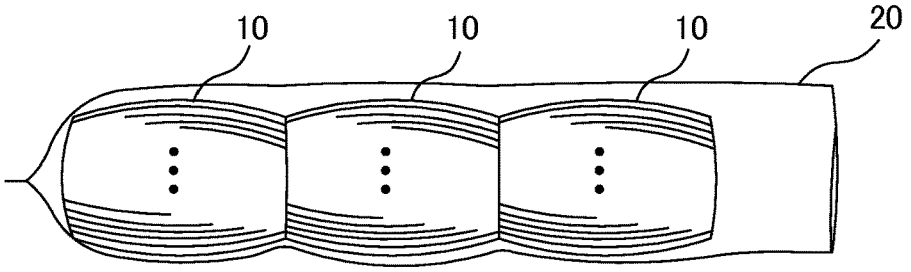
FIGS. 3A-3C are drawings for explaining the method for packing the stacked bundles made of paper of the first embodiment.
Figure 3B:
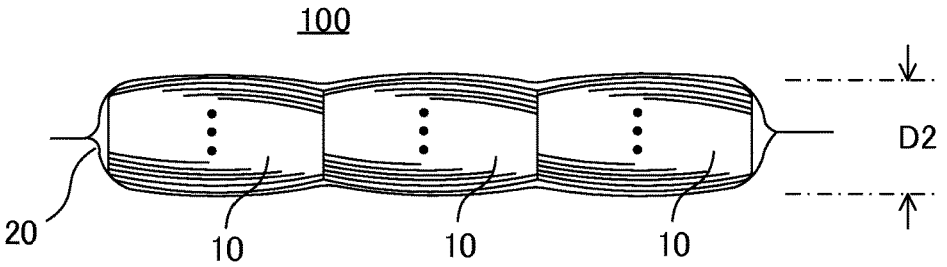
Figure 3C:
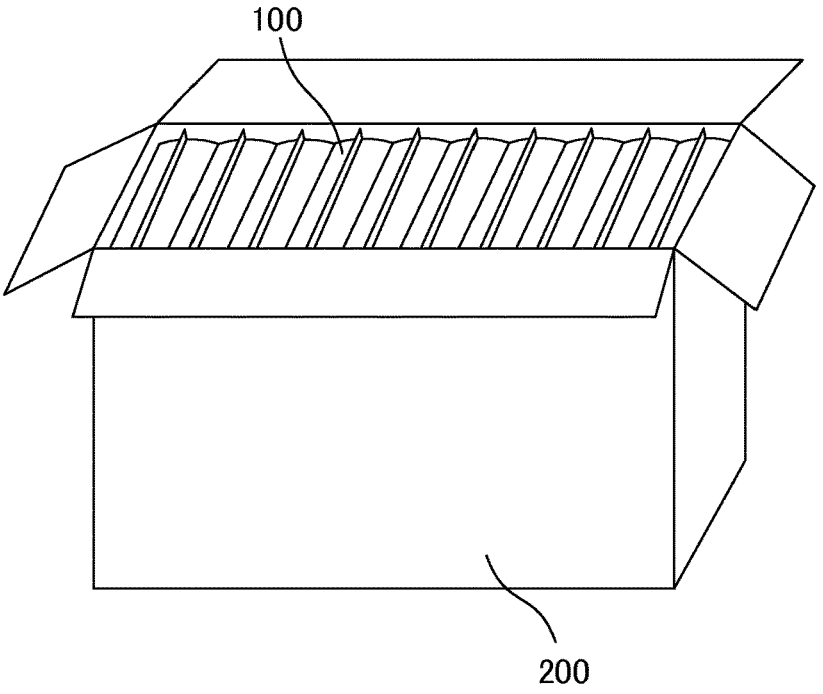
Figure 4:
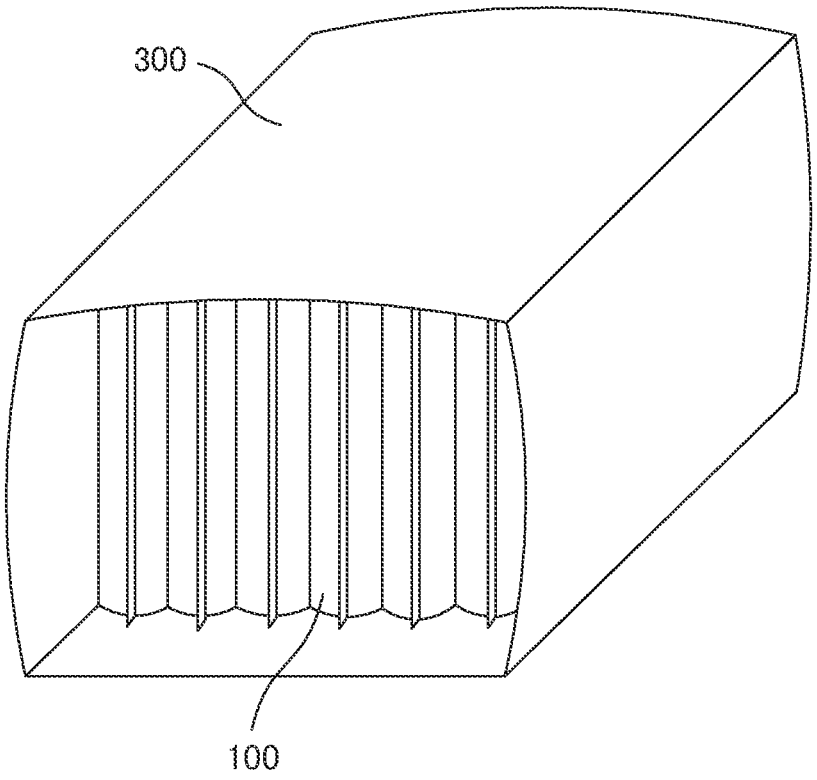
FIG. 4 is a drawing for explaining the method for packing the stacked bundles made of paper of the first embodiment.

Next, a method for packing the stacked bundles made of paper according to the first embodiment of the present invention will be described. FIG. 2 is a flowchart for explaining an operation procedure according to the method for packing the stacked bundles made of paper of the first embodiment, and FIG. 3 and FIG. 4 are drawings for explaining the method for packing the stacked bundles made of paper of the first embodiment.

The method for packing the stacked bundles made of paper of the first embodiment includes a compression process and a packing process. The compression process is a process in which plural bundles of the paper towels are packaged by a freely deformable packaging member, air in the packaging member is sucked to compress the plural bundles of the paper towels, whereby a vacuum packaged body in which the plural bundles of the paper towels are at least temporarily vacuum packaged is produced. Also, the packing process is a process in which a plurality of the vacuum packaged bodies produced in the compression process are packed in the predetermined storing body. Incidentally, in the following, the case where a bundle of the paper towels shown in FIG. 1 is used is considered.

First, an operator preforms an operation in the compression process. In the compression process, the operator firstly puts, for example, three bundles of the paper towels 10, 10 and 10 in a predetermined bag-shaped packaging member 20 (S11) as shown in FIG. 3(*a*). At this time, three bundles of the paper towels 10, 10 and 10 are laterally arranged in the packaging member 20. As such a packaging member 20, any packaging member may be used as long as it can maintain a vacuum state of the vacuum packaged body at least temporarily (for example, at least several minutes) when three bundles of the paper towels 10, 10 and 10 are vacuum-packaged to produce the vacuum packaged body. In the first embodiment, as the packaging member 20, a commercially available bag is used, which is not a special bag for carrying out vacuum-packaging. More specifically, the commercially available packaging member 20 is a transparent bag made of polyethylene, and a thickness thereof is about 0.015 mm. Accordingly, the commercially available packaging member 20 has a property of only temporarily maintaining the vacuum state of the vacuum packaged body.

Next, by using a predetermined vacuum apparatus, the operator performs sucking of air in the packaging member 20 in which three bundles of the paper towels 10, 10 and 10 have been put (S12). As the vacuum apparatus, for example, a double chamber type vacuum packaging machine is desirably used. More specifically, examples of the double chamber type vacuum packaging machine may include a vacuum packaging machine FVM-WM for a large-sized meat manufactured by Furukawa MFG. Co., Ltd. In the double chamber type vacuum packaging machine, a lid portion of the upper portion thereof moves to the left and the right so that the double chamber type vacuum packaging machine has a merit of being able to carry out the operation continuously. In addition, in the double chamber type vacuum packaging machine, during the operation, vacuum-packaging is carried out while the bundles of the paper towels 10 are held down from upward by the lid portion so as to prevent the bundles of the paper towels 10 from moving turbulently, so that air can be uniformly sucked at any portion of the packaging member 20 in which three bundles of the paper towels 10 have been put, whereby three bundles of the paper towels 10 can be substantially uniformly compressed along the stacked direction of the sheet-like member made of paper 11. Further, in the vacuum packaging machine, it is possible to seal the opening portion of the packaging member 20 simultaneously with the suction of air.

A vacuum packaged body 100 in which three bundles of the paper towels 10, 10 and 10 have been vacuum-packaged can be obtained by sucking air in the packaging member 20 using the vacuum apparatus and compressing three bundles of the paper towels 10, 10 and 10 as shown in FIG. 3(*b*). In this case, more specifically, air in the packaging member 20 is sucked until a thickness of the bundles of the paper towels 10 reduces to about a half or so. Therefore, a thickness D2 of the vacuum packaged body 100 immediately after vacuum packaging becomes about a half or so (about 3 cm) of a thickness D1 (about 6 cm) of the normal bundle of paper towels that is not compressed. As mentioned above, in the first embodiment, since a commercially available bag is used as the packaging member 20, which is not a special bag for carrying out vacuum-packaging, the packaging member 20 is gradually swelling out when a certain period of time passes since vacuum-packaging. The present inventors have carried out an experiment to examine how long the vacuum packaged body 100 can maintain the vacuum state when the packaging member 20 of the above-described commercially available product to be used in the first embodiment is used. And as a result of the experiment, when the packaging member 20 of the above-described commercially available product is used, it can be confirmed that the vacuum state of the vacuum packaged body 100 can be maintained 2 to 3 hours. The operator performs operations in such a compression process repeatedly to produce a plurality of the vacuum packaged bodies 100.

Next, the operator performs an operation in the packing process. In the packing process, the operator firstly packs a plurality of the vacuum packaged bodies 100 in a predetermined storing body (S13). Here, as the storing body, a rectangular parallelepiped shape corrugated cardboard box 200 as shown in FIG. 3(*c*), or a rectangular parallelepiped shape bag (a kraft bag) 300 made of kraft paper as shown in FIG. 4 may be used. Whether either of the corrugated cardboard box 200 or the kraft bag 300 is used is determined based on a whole weight of the bundles of the paper towels to be packed in the storing body or quality of the bundles of the paper towels, etc.

Now, the case where the vacuum packaged body 100 is packed in the corrugated cardboard box 200 is explained. Here, the corrugated cardboard box 200 having a size in which three bundles of the uncompressed paper towels laterally arranged can be put in the cardboard box 200 in the state of being arranged in five rows in the horizontal direction in the standing state is used. A thickness of the bundles of the compressed paper towels 10 in the vacuum packaged body 100 is about a half or so of a thickness of the normal bundles of the paper towels that is not compressed, so that, as shown in FIG. 3(*c*), the bundles of the compressed paper towels 10 can be put in the corrugated cardboard box 200 with a number of about 2-fold that is larger than the containable number of the bundles of the uncompressed paper towels. That is, in the corrugated cardboard box 200, the vacuum packaged bodies 100 can be put in 10 rows in the horizontal direction in the standing state.

Also, since a thin bag made of polyethylene is used as a packaging member 20 of the vacuum packaged body 100, when several hours pass since vacuum-packaging, a thickness of the vacuum packaged body 100 swells 3 to 5 cm or so. According to this phenomenon, the bundles of the paper towels 10 in the vacuum packaged body 100 are in the state of being firmly and densely packed in the corrugated cardboard box 200. Thereafter, the operator closes the opening portion of the corrugated cardboard box 200, and attaches gummed tapes, for example, to the closed portion to seal the corrugated cardboard box 200 (S14). Thus the corrugated cardboard box 200 in which the bundles of the paper towels 10 have been packed becomes firm and strong, not easily collapsing by pressure. Therefore, for example, even when the corrugated cardboard boxes 200 are piled up at the time of transportation, the corrugated cardboard boxes 200 can be easily handled without being conscious of damage of the corrugated cardboard boxes 200.

Next, the case where the vacuum packaged body 100 is packed in the kraft bag 300 is explained. The kraft bag 300 is made of kraft paper, and includes a hollow quadrangular prism-shaped cylindrical portion, and a quadrangular bottom portion. The manufacturing process of such a kraft bag 300 includes a cylinder producing process in which a sheet of kraft paper is folded, and a cylinder portion is produced by forming the sheet of kraft paper into a hollow quadrangular prism-shape, and a bottom attaching process in which a quadrangular bottom portion is produced by using a sheet of kraft paper, and the bottom portion is attached to one end of the cylinder portion produced in the cylinder producing process. Also, a size of the kraft bag 300 is designed in advance depending on the sizes and the number of the vacuum packaged bodies 100. For example, the kraft bag 300 having a size in which the vacuum packaged bodies 100 can be put in the kraft bag 300 in six rows in the horizontal direction in the standing state, and yet, when these vacuum packaged bodies 100 are put in the kraft bag 300, a slight gap is generated is used. Thus, as shown in FIG. 4, six vacuum packaged bodies 100 can be easily put in the kraft bag 300. Also, in the first embodiment, the kraft bag 300 having a thickness of about 50 g/m$^2$ is used.

After the six vacuum packaged bodies are thus put in the kraft bag 300, a short time later, the vacuum packaged bodies 100 are swelling. According to this phenomenon, the bundles of the paper towels 10 in the vacuum packaged bodies 100 are in the state of being firmly and densely packed in the kraft bag 300. Here, the kraft paper has a property that it is strong against the swelling power, so that even when the vacuum packaged bodies 100 are swelled, the kraft bag 300 is never torn. Thereafter, the operator closes the opening portion of the kraft bag 300 and seals the kraft bag 300 (S14). Thus the kraft bag 300 in which the bundles of the paper towels 10 have been packed becomes firm and strong, not easily collapsing by pressure, so that even when the kraft bags 300 are piled up at the time of transportation or at the time of storage in a warehouse, etc., the kraft bag 300 can be easily handled without being conscious of damage of the kraft bag 300. Also, the kraft bag 300 is more inexpensive than the corrugated cardboard box 200, so that, if the kraft bag 300 is used as a storing body, remarkable cost reduction of the packing material can be done as compared with the case where the corrugated cardboard box 200 is used.

Incidentally, a storing body having a structure in which two kraft bags are overlapped may be used. In this case, if the kraft bag at the outside is torn or perforated during the transportation, due to the presence of the kraft bag at the inside, the vacuum packaged body therein is never stained.

In the method for packing the stacked bundles made of paper of the first embodiment, the plural bundles of the paper towels are compressed to produce the vacuum packaged body, and a plurality of the vacuum packaged bodies are packed in the storing body, whereby much amount of the bundles of the paper towels can be put in the storing body as compared with the case where the bundles of the paper towels are not compressed. Therefore, transportation cost of the bundles of the paper towels can be reduced and a space necessary for storing the bundles of the paper towels, for example, in a warehouse, etc., can be reduced.

Also, by using the packaging member to be used for producing the vacuum packaged body, the packaging member having a property of only temporarily maintaining the vacuum state of the vacuum packaged body, the packaging member of the vacuum packaged body is, for example, gradually swelled out when several hours pass since vacuum-packaging, so that even if there is a little gap in the storing body in which the vacuum packaged bodies are packed, the bundles of the paper towels are made the state of being firmly and densely packed in the storing body. Thus, the storing body become firm and strong, not easily collapsing by pressure. Accordingly, even if the storing bodies are piled up at the time of transportation or at the time of storage in a warehouse, etc., the storing bodies can be easily handled without being conscious of damage of the storing bodies. In this case, in particular, when a kraft bag is used as the storing body, for example, as compared with the case where a corrugated cardboard box is used, remarkable cost reduction of packing materials can be done. In addition, the package can be easily unpacked only by cutting the kraft bag, or by tearing the kraft bag off by hands.

By the way, in place of packaging the bundles of the paper towels by a packaging member and sucking air in the packaging member to compress the bundles of the paper towels, it is also possible to directly compress the bundles of the paper towels by applying a pressure to the bundles of the paper towels by a press machine. However, if the bundles of the paper towels are compressed by the press machine, the compressed sheet-like members made of paper are attached to each other whereby the sheet-like members made of paper are damaged. In contrast, in the method for packing the stacked bundles made of paper of the first embodiment, since air in the packaging members is sucked to compress, the sheet-like members made of paper are never damaged by the compression.

Second Embodiment

Figure 5:
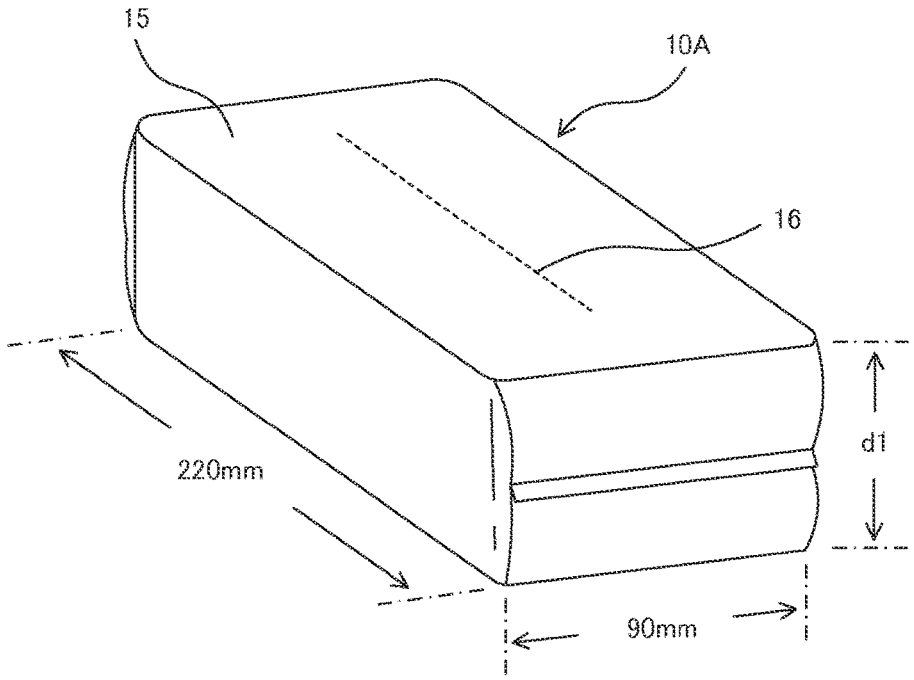
FIG. 5 is a schematic perspective view of a bundle of paper towels (the stacked bundle made of paper) to be used in a method for packing the stacked bundles made of paper of the second embodiment.
Figure 6:
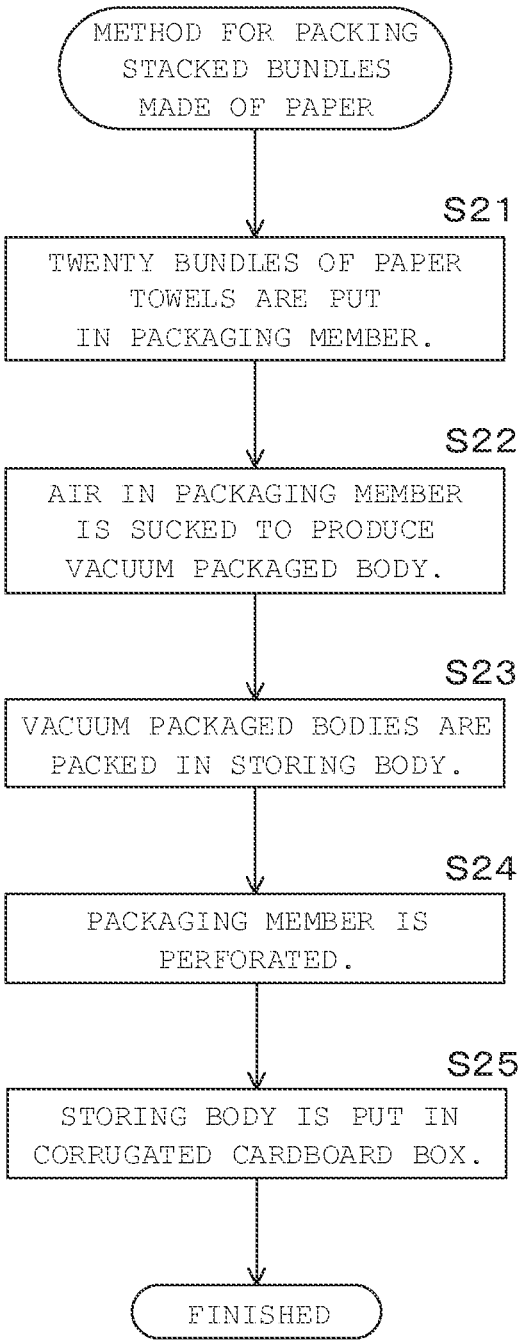
FIG. 6 is a flowchart for explaining an operation procedure according to the method for packing the stacked bundles made of paper of the second embodiment.
Figure 7A:
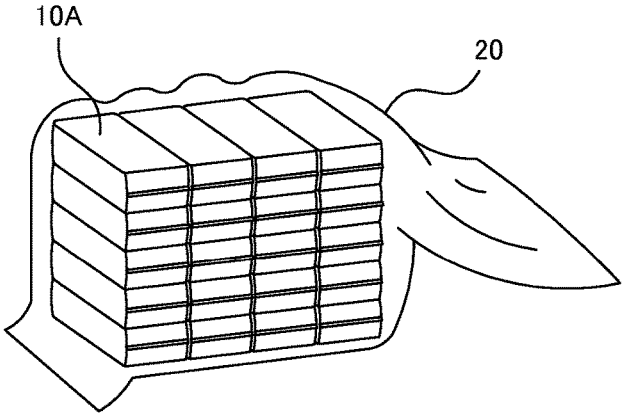
FIGS. 7A-7E are drawings for explaining the method for packing the stacked bundles made of paper of the second embodiment.
Figure 7B:
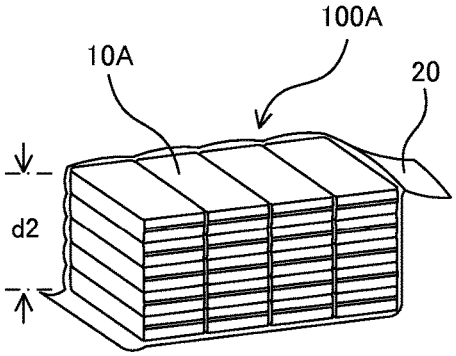
Figure 7C:
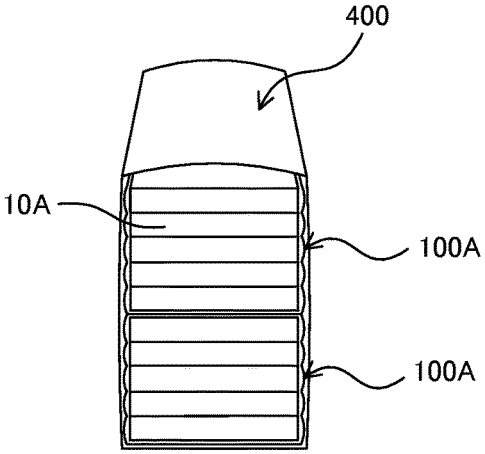
Figure 7D:
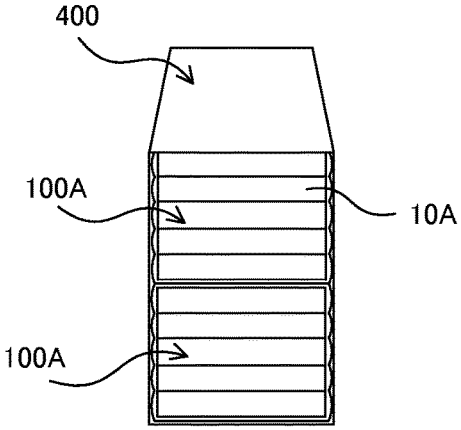
Figure 7E:
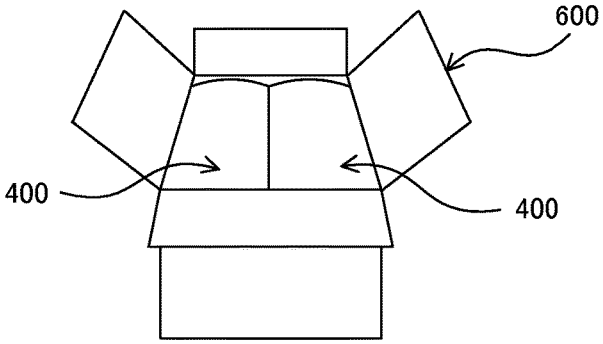

Next, the method for packing the stacked bundles made of paper according to the second embodiment of the present invention will be described. FIG. 5 is a schematic perspective view of a bundle of paper towels (the stacked bundle made of paper) to be used in the method for packing the stacked bundles made of paper of the second embodiment. FIG. 6 is a flowchart for explaining an operation procedure according to the method for packing the stacked bundles made of paper of the second embodiment, and FIG. 7 is a drawing for explaining the method for packing the stacked bundles made of paper of the second embodiment.

The method for packing the stacked bundles made of paper of the second embodiment includes, similar to the first embodiment, a compression process and a packing process. The main points in which the method for packing the stacked bundles made of paper of the second embodiment is different from the method for packing the stacked bundles made of paper of the first embodiment are the point that, in the compression process, a plurality of the stacked bundles made of paper are put in the packaging member in the state of being arranged in a plurality of rows in the horizontal direction and piled in a plurality of steps in the vertical direction, and the point that, in the packing process, a plurality of the vacuum packaged bodies produced in the compression process are packed in the storing body made of kraft paper, then, a plurality of the vacuum packaged bodies are made the state of being densely packed in the storing body by perforating the packaging member.

Also, in the second embodiment, as the stacked bundle made of paper, a bundle of paper towels different from a bundle of paper towels used in the first embodiment is used. That is, in the above-described first embodiment, as the stacked bundle made of paper, as shown in FIG. 1, a bundle of paper towels 10 in which 200 sheet-like members made of paper are tied with a paper band 12 is used, but in the second embodiment, as the stacked bundle made of paper, as shown in FIG. 5, a bundle of paper towels 10A that is completely packaged by putting 200 sheet-like members made of paper in, for example, a bag 15 made of polyethylene is used. On the bag 15, a name of the merchandise and a name of the manufacturer/seller, etc., are printed. Many of the commercially available bundles of paper towels are of the type completely packaged like this. Here, with regard to the bundle of paper towels 10A, a width is about 90 mm, a length is about 220 mm and a thickness d1 is about 60 cm. In general, on the bag 15 made of polyethylene, a perforation 16 for taking out a sheet-like member made of paper one by one is formed. Thus, when the bundles of the paper towels 10A are packed by applying the present invention, if a bundle of the paper towel 10A is taken out from the storing body, the compressed sheet-like members made of paper are swelled so as to return the original shape, then the bag 15 made of polyethylene also swells and the perforation 16 of the bag is broken in some cases. Therefore, when the bundles of the paper towels 10A that has been completely packaged by the bag 15 made of polyethylene are used, it is desirable to previously form one or a plurality of holes in the bag 15 made of polyethylene.

The operator performs a packing operation of the bundles of the paper towels 10A according to the flowchart shown in FIG. 6. First, the operator performs an operation in the compression process. In this compression process, the operator firstly puts 20 bundles of the paper towels 10A, 10A, . . . in a predetermined bag-shaped packaging member 20 (S21) as shown in FIG. 7(*a*). More specifically, 20 bundles of the paper towels 10A, 10A, . . . are in the state of being arranged in four rows in the lateral direction and piled up in five steps in the vertical direction in the packaging member 20. Also, in the second embodiment, similar to the first embodiment, as the packaging member 20, not a special bag for carrying out vacuum-packaging, but a commercially available bag that has a property of only temporarily maintaining the vacuum state of the vacuum packaged body is used. However, a size of the packaging member 20 to be used in the second embodiment is larger than a size of the packaging member 20 to be used in the first embodiment.

Next, the operator performs sucking of air in the packaging member 20 in which 20 bundles of the paper towels 10A, 10A, . . . have been put, by using a predetermined vacuum apparatus (S22). FIG. 8 is a schematic perspective view of a vacuum apparatus to be used in the method for packing the stacked bundles made of paper of the second embodiment. Here, in FIG. 8(*a*), the vacuum apparatus 700 with a lid portion 710 open is shown, and in FIG. 8(*b*), the vacuum apparatus 700 with the lid portion 710 closed is shown. In the vacuum apparatus 700, as shown in FIG. 8(*a*), two containing portions 720 are provided for containing the packaging member 20 in which 20 bundles of the paper towels 10A, 10A, . . . have been put. That is, when the vacuum apparatus 700 is used, two packaging members 20 in which 20 bundles of the paper towels 10A, 10A, . . . have been put can be simultaneously treated. Each containing portion 720 consists of four guide members 721. A size of each containing portion 720 is so designed that it accords with a size of the packaging member 20 in which 20 bundles of the paper towels 10A, 10A, . . . have been put. Therefore, the packaging member 20 in which 20 bundles of the paper towels 10A, 10A, . . . have been put is so arranged in the containing portion 720 that four side faces of the packaging member parallel to the stacked direction of the sheet-like members made of paper each come into contact with the guide members 721. According to this constitution, when air is sucked, collapse of the bundles of the paper towels 10A, 10A, . . . put in the packaging member 20 can be prevented.

Also, as shown in FIG. 8(*a*), inside the lid portion 710 of the vacuum apparatus 700, two pressing plates 730, 730 for holding the respective packaging members 20, 20 down from above are provided. Each pressing plate 730 moves downward by a hydraulic cylinder 740 shown in FIG. 8(*b*), whereby a predetermined pressure can be applied to the packaging member 20 in which 20 bundles of the paper towels 10A, 10A, . . . have been put, along the stacked direction of the sheet-like members made of paper. Thus, by sucking air while holding the packaging member 20 down from above by each pressing plate 730, the packaging member 20 in which 20 bundles of the paper towels 10A, 10A, . . . have been put can be prevented from moving turbulently during the suction operation, so that air can be uniformly sucked at any portion of the packaging member 20. Accordingly, 20 bundles of the paper towels 10A, 10A, . . . put in the respective packaging members 20 and 20 are substantially uniformly compressed along the stacked direction of the sheet-like members made of paper. Further, a sealing apparatus 750 is provided to the vacuum apparatus 700 as shown in FIG. 8(*a*), the opening portions of the respective packaging members 20, 20 can be sealed simultaneously with the suction of air. More specifically, the sealing apparatus 750 seals a predetermined portion of the packaging member 20 by heating and welding the portion.

Figure 9:
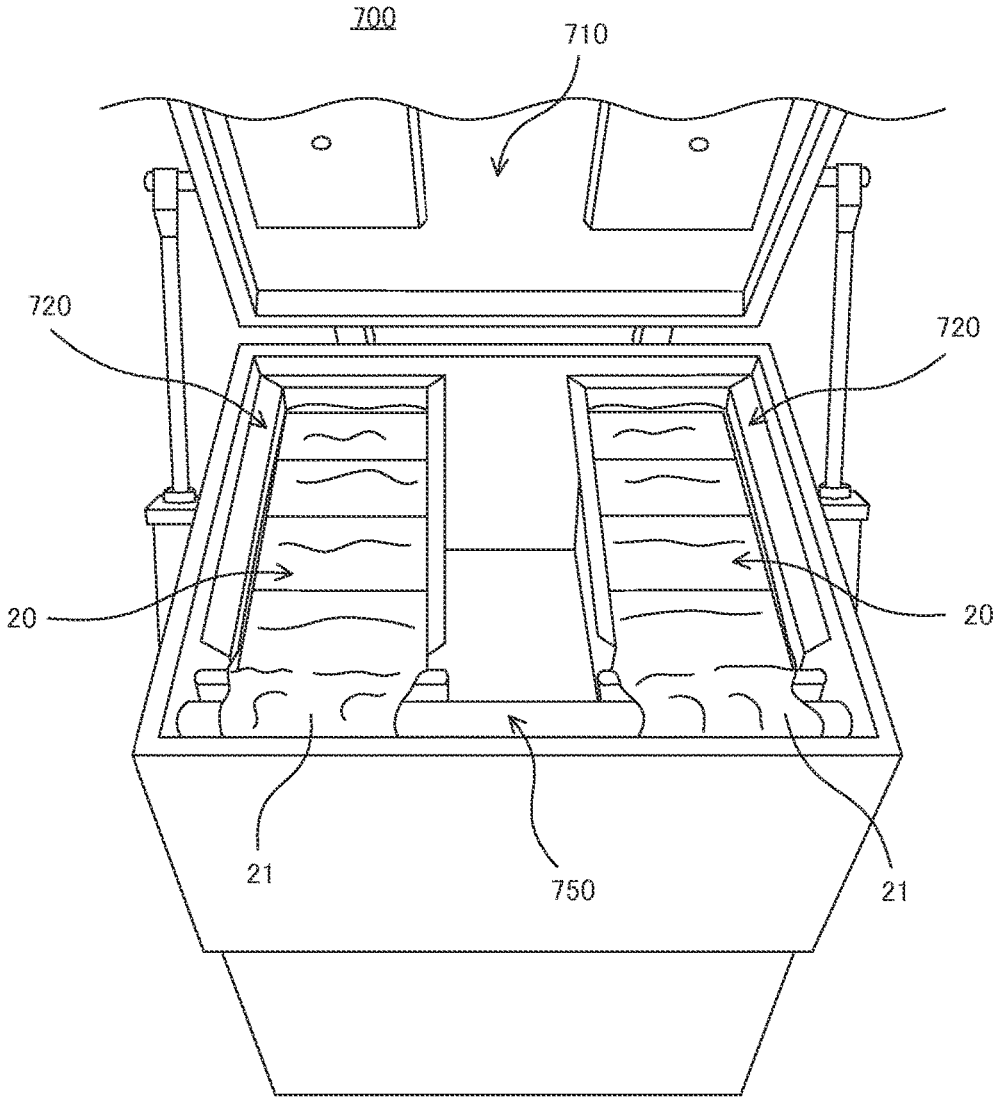
FIG. 9 is a drawing showing the situation that packaging members are put in containing portions of the vacuum apparatus of FIG. 8.

More specifically, the operator firstly puts the two packaging members 20, 20 in the containing portions 720, 720 at the left and right, respectively. Here, in FIG. 9, the situation that the packaging members 20 are put in the containing portions 720 of the vacuum apparatus 700 is shown. As shown in FIG. 9, each packaging member 20 is put in the containing portion 720 such that the opening portion 21 thereof is positioned on the nearer side, and the opening portion 21 is set on the sealing apparatus 750. Next, the operator closes the lid portion 710, and operates the hydraulic cylinder 740 to apply a predetermined pressure to each packaging member 20. Thereafter, when the operator pushes a predetermined treatment starting button (not shown in the drawing), the vacuum apparatus 700 performs a treatment of sucking air in the inside thereof. At this time, the sealing apparatus 750 performs a treatment of sealing the opening portion 21 of the packaging member 20. When the treatments are thus terminated, the operator opens the lid portion 710, and takes out the two packaging members 20, 20 that have been subjected to the vacuum suction treatment.

By using the vacuum apparatus 700, air in the packaging member 20 is sucked to compress 20 bundles of the paper towels 10A, 10A, . . . , so that the vacuum packaged body 100A in which 20 bundles of the paper towels 10A, 10A, . . . have been vacuum-packaged can be obtained as shown in FIG. 7(*b*). In this case, more specifically, air in the packaging member 20 is sucked until a thickness of the bundles of the paper towels 10A reduces to about a half or so. Therefore, a thickness d2 of the vacuum packaged body 100A immediately after vacuum-packaging becomes about a half or so (about 3 cm) of a thickness d1 (about 6 cm) of the normal bundle of paper towels 10A that is not compressed. The operator performs operations in such a compression process repeatedly to produce a plurality of the vacuum packaged bodies 100A.

Next, the operator performs an operation in the packing process. In the packing process, the operator firstly packs two vacuum packaged bodies 100A, 100A in a predetermined storing body (S23). Here, as the storing body, as shown in FIG. 7(*c*), a hollow cylindrical body 400 produced by gluing opposite ends of a rectangular shaped sheet of kraft paper is used. The hollow cylindrical body 400 having a size in which two piled vacuum packaged bodies 100A, 100A can be put in it, and yet, a slight gap is generated when these vacuum packaged bodies 100A, 100A are put in the cylindrical body is used. Therefore, as shown in FIG. 7(*c*), two vacuum packaged bodies 100A, 100A can be easily put in the cylindrical body 400. Also, in the second embodiment, two sheets of kraft paper having a thickness of about 75 g/m$^2$ are piled up, and the hollow cylindrical body 400 is produced by using the two piled sheets of kraft paper. That is, the hollow cylindrical body 400 has a double structure. According to this constitution, if the kraft paper at the outside is torn or perforated during the transportation, due to the presence of the kraft paper at the inside, the vacuum packaged body 100A therein is never stained.

Thus, after two vacuum packaged bodies 100A, 100A are put in the hollow cylindrical body 400, the operator perforates the packaging member 20 used in each vacuum packaged body 100A (S24). More specifically, the operator perforates one or a plurality of portions of the packaging member 20 by using a needle or a gimlet, etc. According to this procedure, air is taken in the packaging member 20 from the hole to swell each vacuum packaged body 100A, and 40 bundles of the paper towels 10A are in the state of being firmly and densely packed in the cylindrical body 400 as shown in FIG. 7(*d*). Here, in the second embodiment, the hollow cylindrical body 400 has a double structure, and the cylindrical body 400 has high strength, so that even when each vacuum packaged body 100A is swelled, the cylindrical body 400 is never torn. Also, as shown in FIG. 7(*d*), an appearance of the cylindrical body 400 in which 40 bundles of the paper towels 10A have been packed is neat. Thereafter, the operator puts, as shown in FIG. 7(*e*), for example, two cylindrical bodies 400, 400 in which 40 bundles of the paper towels 10A have been packed in a predetermined corrugated cardboard box 500 (S25). Then, the operator closes the opening portion of the corrugated cardboard box 500, and attaches gummed tapes, etc., to the closed portion to seal the corrugated cardboard box 500. Thus, the packing operation of the bundles of the paper towels 10A is finished.

Incidentally, in the packing process, in place of putting the vacuum packaged bodies in the hollow cylindrical body, the vacuum packaged bodies may be put in a kraft bag and the opening portion of the kraft bag may be closed. That is, as the storing body, the kraft bag may be used. Here, the kraft bag produced by overlapping two sheets of kraft paper each having a thickness of about 75 g/m$^2$ is desirably used. In this case, the packing process is completed at this stage, and it is not necessary that the vacuum packaged bodies put in the kraft bag are further put in the corrugated cardboard box. Thus, the amount of the recyclable waste can be markedly reduced. And yet, there is a merit that the kraft bags in which the vacuum packaged bodies have been packed can be stored by piling up on pallets, for example, in a warehouse, etc.

In the method for packing the stacked bundles made of paper of the second embodiment, similar to the method for packing the stacked bundles made of paper of the first embodiment, the plural bundles of the paper towels are compressed to produce the vacuum packaged body, and a plurality of the vacuum packaged bodies are packed in the storing body, whereby much amount of the bundles of the paper towels can be put in the storing body as compared with the case where the bundles of the paper towels are not compressed. Therefore, transportation cost of the bundles of the paper towels can be reduced and a space necessary for storing the bundles of the paper towels, for example, in a warehouse, etc., can be reduced. In particular, in the second embodiment, a plurality of the stacked bundles made of paper are put in the packaging member in the state of being arranged in a plurality of rows and piled in a plurality of steps in the compression process, so that the operation in the compression process can be carried out efficiently. Also, in the packing process, after a plurality of the vacuum packaged bodies produced in the compression process are packed in the storing body made of kraft paper, the packaging member is perforated to make a plurality of the vacuum packaged bodies the state of being densely packed in the storing body, so that the packing operation can be finished within a short period of time. Further, since the storing body made of kraft paper is used, the package can be easily unpacked only by cutting the kraft paper, or by tearing the kraft paper off by hands.

Incidentally, the present invention is not limited to the embodiments described above, and can be modified in various ways within the scope of the spirit thereof.

For example, in the above-described respective embodiments, the case where air in the packaging member is sucked until a thickness of the bundles of the paper towels that are the stacked bundles made of paper reduces to about a half or so in the compression process is explained, and in general, air in the packaging member may be sucked so that a thickness of the stacked bundles made of paper reduces by 30% to 70% or so in the compression process. This is because, depending on the quality of the sheet-like member made of paper which constitutes the stacked bundles made of paper, some stacked bundles made of paper can be compressed significantly, and the other stacked bundles made of paper cannot be compressed too much.

Also, in the above-described first embodiment, the case where three stacked bundles made of paper are put in the packaging member and then vacuum-packaging is carried out in the compression process is explained, but two or four or more of the stacked bundles made of paper may be put in the packaging member and then vacuum-packaging may be carried out. Or else, one stacked bundle made of paper alone may be put in the packaging member and then vacuum-packaging may be carried out. Furthermore, in the above-described second embodiment, the case where the stacked bundles made of paper which are arranged in four rows in the short side direction and piled in five steps are put in the packaging member and then vacuum-packaging is carried out in the compression process is explained, and in general, a number of the stacked bundles made of paper to be put in the packaging member, and a manner of the arrangement of the stacked bundles made of paper in the packaging member may be determined, for example, depending on a shape and a size, etc., of the stacked bundle made of paper.

Also, in the above-described respective embodiments, the case where the operator puts a plurality of the stacked bundles made of paper in a bag-shaped packaging member by manual operation in the compression process is explained, and, for example, a plurality of the stacked bundles made of paper may be automatically packaged in a sheet-like packaging member using a packaging machine.

Further, in the above-described respective embodiments, the case where a commercially available thin bag made of polyethylene is used as the packaging member for packaging a plurality of the stacked bundles made of paper in the compression process is explained, and the packaging member may be a bag made of other resin or a bag made of paper, etc., as long as the stacked bundles made of paper can be temporarily vacuum-packaged. Also, as the packaging member, a special bag for vacuum-packaging with no leakage of air may be used.

Also, in the above-described second embodiment, the case where the storing body with a double structure which is produced by overlapping two sheets of kraft paper having a thickness of about 75 g/m$^2$ is used is explained, and, for example, the storing body may be produced by using a sheet of kraft paper having a thickness of about 150 g/m$^2$. Further, in the above-described respective embodiments, a number of the vacuum packaged bodies to be put in the storing body, and a manner of the arrangement of the vacuum packaged bodies in the storing body may be determined, for example, depending on a shape and a size, etc., of the vacuum packaged body.

Also, in the above-described respective embodiments, the case where a corrugated cardboard box, a kraft bag, a sheet of kraft paper formed into a hollow cylindrical shape are used as the storing body in which a plurality of the vacuum packaged bodies are packed is explained, and the storing body is not limited to the corrugated cardboard box or the kraft bag, etc., and may be, for example, a container made of plastics, etc.

Further, in the above-described respective embodiments, the case where the stacked bundles made of paper to which the method according to the present invention is applied is bundles of paper towels is explained, and the stacked bundles made of paper may be bundles of tissue paper, bundles of sheet-like toilet paper, bundles of sheet-like nonwoven fabric, etc., other than the bundles of the paper towels. Accordingly, in "the sheet-like member made of paper" in the present specification, not only the usual paper produced by using plant fiber such as pulp, etc., as a raw material, but also sheet-like nonwoven fabric produced by using synthetic fiber (for example, rayon, nylon, vinylon, polyester, acrylonitrile, etc.), glass fiber or natural fiber (for example, silk, etc.), etc., as a raw material may be included.

INDUSTRIAL APPLICABILITY

As explained above, in the method for packing the stacked bundles made of paper according to the present invention, the stacked bundles made of paper are compressed to produce the vacuum packaged body, a plurality of the vacuum packaged bodies are packed in the storing body, whereby much amount of the stacked bundles made of paper can be put in the storing body as compared with the case where the stacked bundles made of paper are not compressed, so that transportation cost of the stacked bundles made of paper can be reduced and a space necessary for storing the stacked bundles made of paper, for example, in a warehouse, etc., can be reduced. Accordingly, the present invention is suitably used for packing the stacked bundles made of paper such as bundles of paper towels, tissue paper, toilet paper, etc., produced in a factory in a storing body.

DESCRIPTION OF THE REFERENCE NUMERAL

10, 10A: Bundle of paper towels (stacked bundles made of paper)
11: Sheet-like member made of paper
12: Paper band
15: Bag made of polyethylene
16: Perforation
20: Packaging member
100, 100A: Vacuum packaged body
200: Corrugated cardboard box (storing body)
300: Kraft bag (storing body)
400: Hollow cylindrical body (storing body)
500: Corrugated cardboard box
700: Vacuum apparatus
710: Lid portion
720: Containing portion
721: Guide member
730: Pressing plate
740: Hydraulic cylinder
750: Sealing apparatus

The invention claimed is:

1. A method for packing bundles of sheet-like members, the method comprising:

a packing process in which bundles are stacked and packaged in a packaging member, wherein each of the bundles is formed by stacking sheet-like members and the packaging member comprises an opening;

a vacuumizing process in which air in the packaging member is sucked out through the opening to produce a vacuum-packaged body of which the packaging member temporarily maintains a vacuum state, wherein the air is sucked out until a thickness of the stacked bundles is reduced by 30% to 70% along a stack direction of the sheet-like members;

a wrapping process in which the vacuum-packed body is packed in a bag, wherein the bag is made of kraft paper; and a swelling process in which the sheet-like members are swelled in the bag by air drawn into the vacuum-packed body such that the bag is pressured outwardly by the swelling of the sheet-like members, wherein the packaging member is perforated after the wrapping process such that air is drawn into the packaging member in the swelling process.

2. The method for packing bundles according to claim 1, wherein the stacked bundles are arranged laterally in the packaging member such that the bundles are stacked in a direction perpendicular to the thickness direction of the sheet-like members.

3. The method for packing bundles according to claim 1, the thickness is reduced substantially uniformly for the stacked bundles in the vacuumizing process.

* * * * *